US006692290B2

(12) United States Patent
Yamanashi et al.

(10) Patent No.: US 6,692,290 B2
(45) Date of Patent: Feb. 17, 2004

(54) TERMINAL FITTING

(75) Inventors: Makoto Yamanashi, Shizuoka (JP); Kei Sato, Shizuoka (JP); Takuya Hasegawa, Shizuoka (JP); Shigeru Tanaka, Shizuoka (JP)

(73) Assignee: Yazaki Corporation, Toyko (JP)

( * ) Notice: Subject to any disclaimer, the term of this patent is extended or adjusted under 35 U.S.C. 154(b) by 0 days.

(21) Appl. No.: 10/244,013

(22) Filed: Sep. 16, 2002

(65) Prior Publication Data

US 2003/0054684 A1 Mar. 20, 2003

(30) Foreign Application Priority Data

Sep. 18, 2001 (JP) ..... 2001-282865

(51) Int. Cl.[7] ..... H01R 4/24

(52) U.S. Cl. ..... 439/397; 439/203; 439/399; 439/449; 439/720

(58) Field of Search ..... 439/397, 203, 439/399, 449, 720, 722

(56) References Cited

U.S. PATENT DOCUMENTS 5,380,218 A * 1/1995 Yamamoto et al. ..... 439/397
5,616,047 A * 4/1997 Lutsch ..... 439/397
5,921,804 A * 7/1999 Nagai ..... 439/397
5,980,300 A * 11/1999 Okabe ..... 439/397
6,007,365 A * 12/1999 Atsumi et al. ..... 439/397
6,113,417 A * 9/2000 Furutani et al. ..... 439/397

FOREIGN PATENT DOCUMENTS

JP 2000-58148 2/2000

* cited by examiner

*Primary Examiner*—Dean A. Reichard
*Assistant Examiner*—Jinhee J Lee
(74) *Attorney, Agent, or Firm*—Armstrong, Kratz, Quintos, Hanson & Brooks, LLP

(57) ABSTRACT

A terminal fitting is provided, by which the terminal fitting can be securely connected electrically to an electric wire. A pressure-welding terminal as the terminal fitting has a wire connecting part, to which an electric wire is press-fit. The electric wire includes an electrically conductive core wire and an insulating coating. The wire connecting part includes a bottom wall, and first and second pressure-welding members, each of which has a pair of pressure-welding blades arising from the bottom wall. A projection is formed on an end of an inner edge of the blade near to the bottom wall.

6 Claims, 8 Drawing Sheets

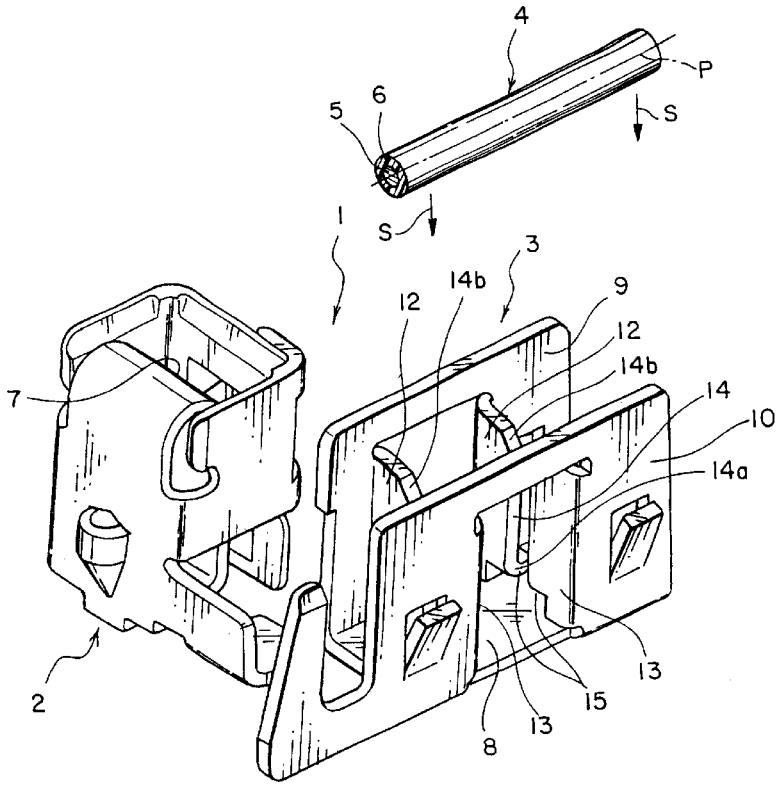
FIG. 1
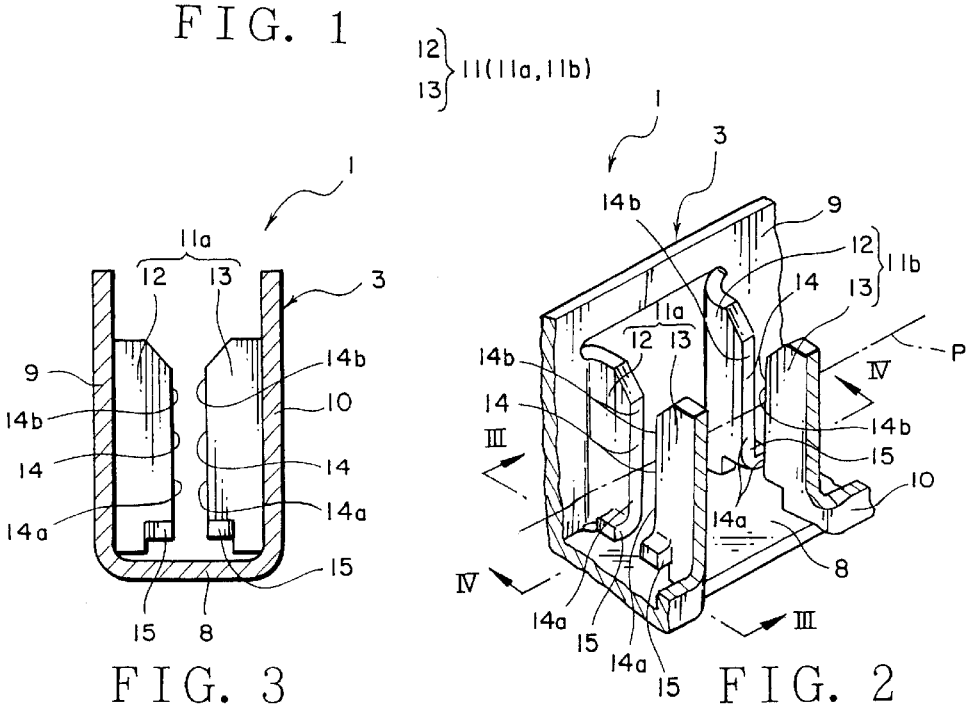
FIG. 3
FIG. 2

TERMINAL FITTING

BACKGROUND OF THE INVENTION (1) Field of the Invention

The present invention relates to a terminal fitting to be electrically connected to an electric wire.

(2) Description of the Related Art

Various electronic instruments are mounted on a motor vehicle. In a motor vehicle, wiring harness is mounted in order to transfer electric power from a power source to the electronic instruments and to transfer a signal from a computer to the electronic instruments. The wiring harness includes a plurality of electric wires (hereinafter, wires) 101 (only one wire being shown in FIGS. 22A, 22B and 22C by its cross sectional view) tied up in a bundle with each other and terminal fittings attached to the end of the wires 101. The wire 101 includes an electrically conductive (hereinafter, conductive) core wire 102 and an insulating coating 103 which coats the core wire 102. The terminal fitting is formed by bending a conductive metal plate. The terminal fitting is electrically connected to the core wire 102 of the wire 101.

As the terminal fitting, a pressure-welding terminal 100 shown in FIG. 20 may be utilized. As shown in FIGS. 20 and 21, the pressure-welding terminal 100 has a plurality of pressure-welding members 104. Each pressure-welding member 104 includes a pair of pressure-welding blades 105, 106. As shown in FIGS. 22A, 22B and 22C, in the pressure-welding terminal 100, a wire 101 is press-fit into between the pressure-welding blades 105 and 106 and then, the blades 105 and 106 cut the coating 103 so as to come in contact with the core wire 102, thereby the pressure-welding terminal 100 is electrically connected to the wire 101.

As for the conventional pressure-welding terminal 100 described above, when the wire 101 is press-fit into between the pressure-welding blades 105 and 106, as shown in FIG. 22C, the pressure-welding terminal 100 possibly is plastically deformed in the direction, in which the distance between the pressure-welding blades 105 and 106 increases. If the distance between the pressure-welding blades 105 and 106 increases, each inner edge of the pressure-welding blades 105 and 106 possibly does not come in contact with the core wire 102 of the wire 101. That is, there has been a problem that the electric connection between the conventional pressure-welding terminal 100 and the wire 101 is possibly not secured.

SUMMARY OF THE INVENTION

It is therefore an objective of the present invention to solve the above problem and to provide a terminal fitting, which securely can be electrically connected to an electric wire.

In order to attain the above objective, the present invention is to provide a terminal fitting comprising:

- a bottom wall, on a surface of which an electric wire consisting of a core wire and a coating is placed;
- a pair of pressure-welding blades arranged in parallel with each other arising from the bottom wall, each pressure-welding blade including an inner edge for cutting the coating of the electric wire; and
- a projection formed on an end of the inner edge of each pressure-welding blade near to the bottom wall, protruding from the end toward the length direction of the electric wire, wherein the electric wire is press-fit into between the pair of pressure-welding blades, which cuts the coating of the electric wire so as to come in contact with the core wire of the electric wire.

With the construction described above, when the wire is press-fit into between the blades, the wire comes in contact with the projection since the projection is formed on the end of the blade near to the bottom wall. Then, the wire pushes the projection toward the bottom wall. Since the projection is formed on the end of the blade, the blades are displaced in the direction, in which both ends situated at far side from the bottom wall approach each other. That is, the distance between both blades decreases.

Further, the projection protrudes from the end along the length direction of the wire. Therefore, the projection is prevented from coming in contact with the core wire of the wire. That is, the core wire is prevented from being damaged.

Therefore, the distance between both blades is prevented from increasing when the wire is press-fit into between both blades. Each blade securely comes in contact with the core wire, thereby each blade is securely connected electrically to the wire.

Preferably, each projection protrudes in the same direction from the corresponding end.

With the construction described above, when the wire is press-fit into between both blades, the projection securely comes in contact with the wire. Therefore, each blade more securely comes in contact with the core wire and is more securely connected electrically to the wire.

In order to attain the above objective, the present invention is also to provide a terminal fitting comprising:

- a bottom wall, on a surface of which an electric wire consisting of a core wire and a coating is placed;
- a pair of side walls arising from both edges of the bottom wall; and
- first and second pressure-welding members to be pressure-welded to the electric wire, each of which has a pair of pressure-welding blades and a projection protruding from an end of an inner edge of each pressure-welding blade near to the bottom wall, each pressure-welding blade including the inner edge for cutting the coating of the electric wire, and the projection being formed at the end of the inner edge of one pressure-welding blade of the first pressure-welding member near to the bottom wall and formed at the end of the inner edge of the opposite pressure-welding blade of the second pressure-welding member near to the bottom wall, wherein the one pressure-welding blade continues to one side wall while the opposite pressure-welding blade continues to the opposite side wall, and the electric wire is press-fit into between the pair of pressure-welding blades which cuts the coating of the electric wire so as to come in contact with the core wire of the electric wire.

With the construction described above, the wire press-fit into between both blades comes in contact with the projection and pushes the projection toward the bottom wall. Then, both blades are displaced in the direction, in which both ends of the blade situated at far side from the bottom wall approach each other. Therefore, the distance between the pair of side walls can be prevented from increasing and the distance between the pair of blades can be prevented from increasing. Therefore, each blade more securely comes in contact with the core wire and is more securely connected electrically to the wire.

Preferably, the projection protrudes from the end in the length direction of the electric wire.

With the construction described above, when the wire is press-fit into between the pair of blades, the core wire of the wire can be prevented from coming in contact with the projection. Therefore, the core wire can be prevented from being damaged. Each blade can be more securely connected electrically to the wire.

Preferably, protrusion length of the projection from the end gradually increases as the projection approaches the bottom wall.

With the construction described above, when the wire is press-fit into between the blades, the wire comes in contact with the projection since the projection is formed on the end of the blade near to the bottom wall. Then, the wire pushes the projection toward the bottom wall. Since the projection is formed on the end of the blade, the blades are displaced in the direction, in which both ends situated at far side from the bottom wall approach each other. That is, the distance between both blades decreases. Therefore, each blade more securely comes in contact with the core wire and is more securely connected electrically to the wire.

Preferably, protrusion length of the projection from the end gradually increases as the projection leaves the bottom wall.

With the construction described above, even when the wire is press-fit into between both blades and the wire comes in contact with the projection, the protrusion length of the projection from the blade can be prevented from decreasing.

Therefore, the wire can securely push the projection toward the bottom wall and the distance between both blades can be prevented from increasing when the wire is press-fit into between both blades. Therefore, each blade more securely comes in contact with the core wire and is more securely connected electrically to the wire.

BRIEF DESCRIPTION OF THE DRAWINGS

FIG. 1 is a perspective view illustrating a pressure-welding terminal according to a first preferred embodiment of the present invention;

FIG. 2 is a perspective view illustrating a wire connection part of the pressure-welding terminal shown in FIG. 1;

FIG. 3 is a cross sectional view taken along III—III line in FIG. 2;

DESCRIPTION OF THE PREFERRED EMBODIMENTS

Figure 4:
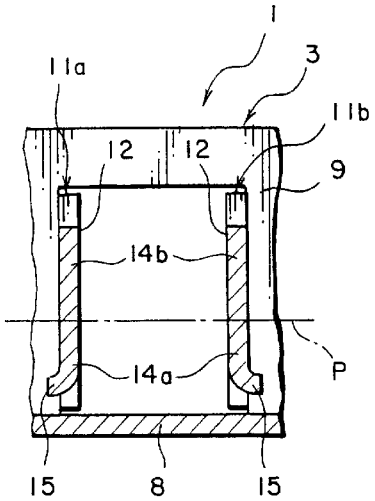
FIG. 4 is a cross sectional view taken along IV—IV line in FIG. 2.

In the following, a pressure-welding, terminal 1 as a terminal fitting according to a first preferred embodiment of the present invention will be explained with reference to FIGS. 1–6. As shown in FIG. 1, the pressure-welding terminal 1 includes an electric contact part 2 for electrically connecting to another terminal fitting and a wire connecting part 3 continuing to the electric contact part 2. In the pressure-welding terminal 1, the electric contact part 2 is electrically connected to another terminal fitting and the wire connecting part 3 is electrically connected to an electric wire 4. As shown in FIGS. 1 and 6, the wire 4 is a so-called coated wire, which includes an electrically conductive core wire 5 and an insulating coating 6 that coats the core wire 5.

The electric contact part 2 is formed in a square cylindrical shape. The electric contact part 2 receives a contact spring 7 inside. A connecting bar (not shown), which is conductive and formed in a band-shape, is inserted into the electric contact part 2. When the connecting bar is inserted in a cylindrical hole of the electric contact part 2, the contact spring 7 pushes the connecting bar toward the inner surface of the cylindrical hole, thereby the electric contact part 2 is electrically connected to the connecting bar.

A plurality of the electric contact parts 2, each of which has the structure described above, are placed one upon another in such a form that the cylindrical holes overlap each other. Then, the connecting bar is inserted into the cylindrical hole, thereby each electric contact part 2, which is placed upon the other electric contact part 2 as described above, is electrically connected to the other electric contact part 2. Thus, the electric contact part 2 is electrically connected to another terminal fitting.

As shown in FIGS. 1 and 2, the wire connecting part 3 includes a flat bottom wall 8 on which the wire 4 is placed, a pair of side walls 9, 10 and a pressure-welding member 11 which pressure-welds itself to the wire 4. The bottom wall 8 is formed in a band-shape. The wire 4 approaches the bottom wall 8 along the direction perpendicular to the bottom wall 8 (shown by arrow S in FIG. 1) and is placed on the bottom wall 8 (i.e., placed on an upper surface of the bottom wall 8) in such a manner that the extending direction (shown by alternate long and short dash line P in FIG. 1) of the wire 4 is in parallel with the length direction of the bottom wall 8.

Each side wall 9, 10 continues to the corresponding edge of the bottom wall 8 in the length direction. That is, each side wall 9, 10 arises from the bottom wall 8. The pair of side walls 9 and 10 puts the wire 4 therebetween.

A plurality of the pressure-welding members 11 are formed in the wire connecting part 3. In FIG. 1 as an example, there are two pressure-welding members 11. In the following, these two pressure-welding members 11 are called the first pressure-welding members 11*a* and the second pressure-welding members 11*b*. Each pressure-welding member 11*a*, 11*b* is arranged having a distance therebetween along the length direction of the bottom wall 8 (i.e., along the alternate long and short dash line P). Each pressure-welding member 11*a*, 11*b* has a pair of pressure-welding blades 12 and 13. That is, the pressure-welding terminal 1 includes the first and second pressure-welding, members 11*a* and 11*b*, respectively, that is, includes two pairs of pressure-welding blades 12, 13. The first pressure-welding member 1*a* has the same structure as that of the second pressure-welding member 11*b*.

Each blade 12, 13 of the first pressure-welding member 11*a* arises from the bottom wall 8. Each blade 12, 13 is arranged along the direction, which crosses the alternate long and short dash line P. That is, each blade 12, 13 is arranged along the extending direction of the wire 4, that is, along the direction, which crosses the wire 4.

One pressure-welding blade 12 of the blades 12 and 13 continues to one side wall 9 of the pair of side walls 9 and 10. The other pressure-welding blade 13 continues to the other side wall 10. The blades 12 and 13 protrude from the side walls 9 and 10, respectively, in the direction of approaching each other. The blades 12 and 13 face each other and have the corresponding inner edge 14 for putting the wire 4 therebetween so as to cut the insulating coating 6 of the wire 4.

As shown in FIGS. 2–4, an end 14*a* of the inner edge 14 near to the bottom wall 8 is provided with a projection 15. That is, the pressure-welding terminal 1 has the projections 15. Every pressure-welding blade 12, 13 has the projection 15.

The projection 15 protrudes from the end 14*a* along the alternate long and short dash line P. Each projection 15 formed on the pair of the blades 12, 13 of the first pressure-welding member 11*a* protrudes in the same direction from the corresponding end 14*a*. The projection 15 of the first pressure-welding member 11*a* and the projection 15 of the second pressure-welding member 11*b* protrude from the corresponding end 14*a* in the opposite direction to each other. The projection 15 is formed in such a manner that the protrusion length of the projection 15 from the inner edge 14 of the blade 12, 13 gradually increases as the projection 15 approaches the bottom wall 8. The projection 15 is provided with a notch at the end 14*a*. The projection 15 is formed by bending a material for the blade 12, 13 along the alternate long and short dash line P by press working and the like.

Figure 5:
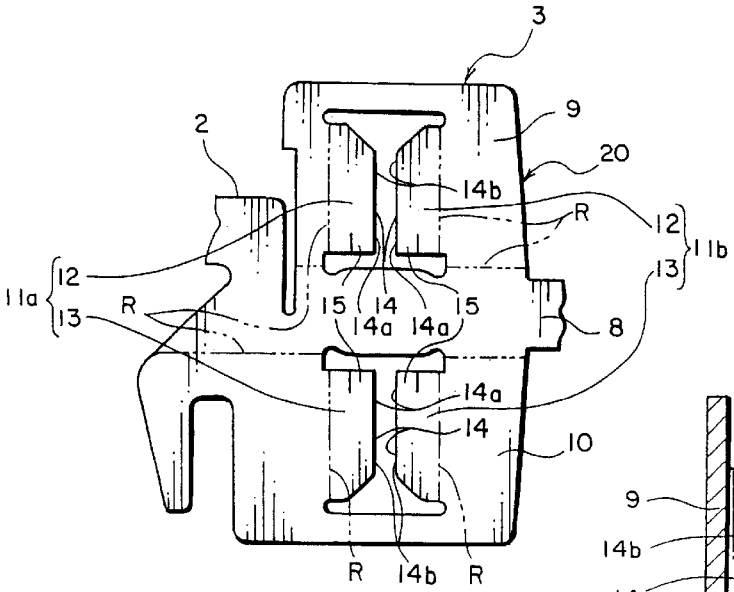
FIG. 5 is a plan view illustrating a part of a metal plate, which forms the pressure-welding terminal shown in FIG. 1.

An electrically conductive metal plate 20 shown in FIG. 5 is bent along alternate long and two short dashes lines R shown in FIG. 5, thereby the electric contact part 2 of the pressure-welding terminal 1 is obtained.

Figure 6A:
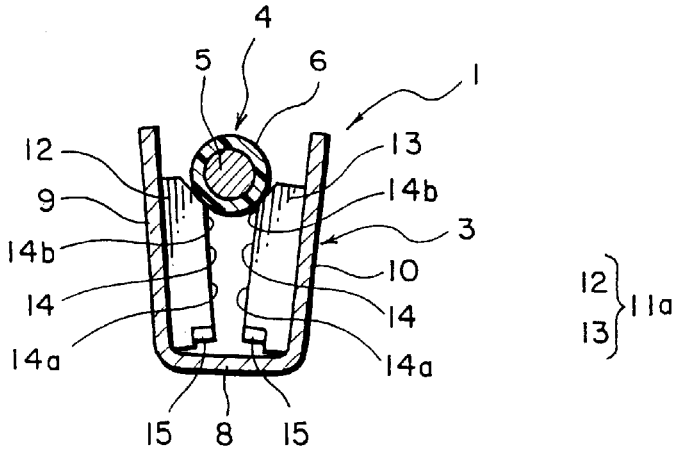
FIGS. 6A, 6B and 6C are a cross sectional view illustrating a process, in which a wire is press-fit into between pressure-welding blades of the wire connection part shown in FIG. 2.

The wire 4 is inserted into between the pressure-welding blades 12 and 13 of the first and second pressure-welding members 11*a* and 11*b* of the wire connecting part 3 of the pressure-welding terminal 1. First, the wire 4 comes in contact with an end 14*b* of the inner edge 14 of the blade 12, 13, which is situated far from the bottom wall 8. Then, if the wire 4 has the outer diameter larger than the distance between the blades 12 and 13, as shown in FIG. 6A, the blades 12 and 13 are displaced in the direction in which the distance between both ends 14*b* increases.

Figure 6B:
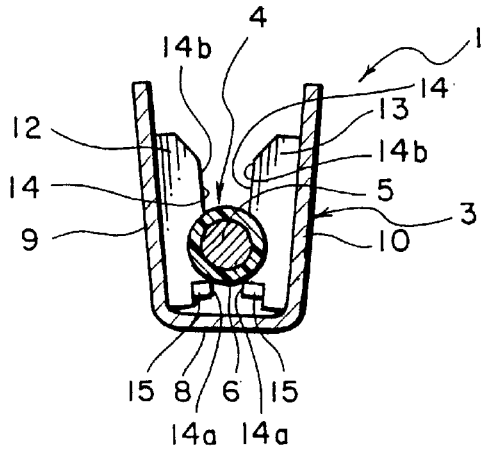
Figure 6C:
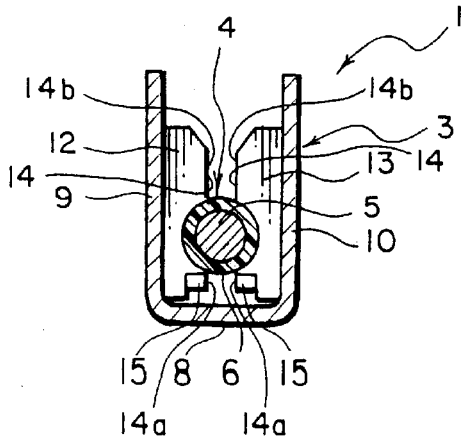

When the wire 4 is press-fit in the direction of approaching the bottom wall 8, the inner edge 14 cuts the coating 6 so as to come in contact with the core wire 5. Then, as shown in FIG. 6B, the wire 4 comes in contact with the projection 15. When the wire 4 approaches the bottom wall 8 further, the wire 4 pushes the projection 15 toward the bottom wall 8, since the projection 15 is formed at the end 14*a* and protrudes from the end 14*a*. Then, as shown in FIG. 6C, the blades 12 and 13 are displaced in the direction, in which the distance between both ends 14*b* decreases. Thus, the blades 12 and 13 are displaced in the direction, in which the distance between the blades 12 and 13 decreases.

Thus, when the wire 4 is press-fit into between the blades 12 and 13, the edges 14 of the blades 12 and 13 cut the coating 6 of the wire 4 so as to come in contact with the core wire 5, thereby the blades 12 and 13 are electrically connected to the core wire 5. Thus, the first and second pressure-welding members 11*a* and 1*b* are press-fit to the wire 4, that is, the pressure-welding terminal 1 is press-fit to the wire 4, thereby the pressure-welding terminal 1 is electrically connected to the wire 4.

With the construction according to the first preferred embodiment, when the wire 4 is press-fit into between the blades 12 and 13, the wire 4 comes in contact with the projection 15, since the projection 15 is formed on the end 14*a* near to the bottom wall 8. Then, the wire 4 pushes the projection 15 toward the bottom wall 8. Then, the blades 12 and 13 are displaced in the direction, in which both ends 14*b* situated far from the bottom wall 8 approach each other, since the projection 15 is formed at the end 14*a* of the blades 12, 13. That is, the distance between the blades 12 and 13 decreases.

Therefore, when the wire 4 is press-fit into between the blades 12 and 13, the distance between the blades 12 and 13 is prevented from increasing. Therefore, the blades 12, 13 securely come in contact with the core wire 5, thereby the pressure-welding terminal 1 is securely electrically connected to the wire 4.

The projection protrudes from the end 14*a* along the alternate long and short dash line P. Therefore, the projection 15 is prevented from coming in contact with the core wire 5 of the wire 4, thereby the core wire 5 is prevented from being damaged. That is, the pressure-welding terminal 1 can be securely electrically connected to the wire 4.

Each projection 15 protruding from the inner edge 14 of the blades 12, 13 of the first pressure-welding member 11*a* protrudes in the same direction from the corresponding end 14*a*. Each projection 15 protruding from the inner edge 14 of the blades 12, 13 of the second pressure-welding member 11*b* protrudes in the same direction from the corresponding end 14*a*. Therefore, when the wire 4 is press-fit into between the blades 12 and 13, the projection 15 securely comes in contact with the wire 4. Therefore, the blades 12 and 13 more securely comes in contact with the core wire 5, thereby the pressure-welding terminal 1 is more securely electrically connected to the wire 4.

The projection 15 protrudes from the inner edge 14 of the blades 12, 13 along the alternate long and short dash line P. The projection 15 is formed in such a manner that the protrusion length of the projection 15 from the inner edge 14 gradually increases as the projection 15 approaches the bottom wall 8. The projection 15 can be formed by bending a material for the inner edge 14 of the blade 12, 13. Therefore, there is no need to enlarge the distance between the blades 12 and 13 in order to form the projection 15. Therefore, the pressure-welding terminal 1 can be prevented from having a large size and can be securely electrically connected to a relatively thin wire 4.

In the following, a pressure-welding terminal 1 as a terminal fitting according to a second preferred embodiment of the present invention will be explained with reference to FIGS. 7–11.

Figure 7:
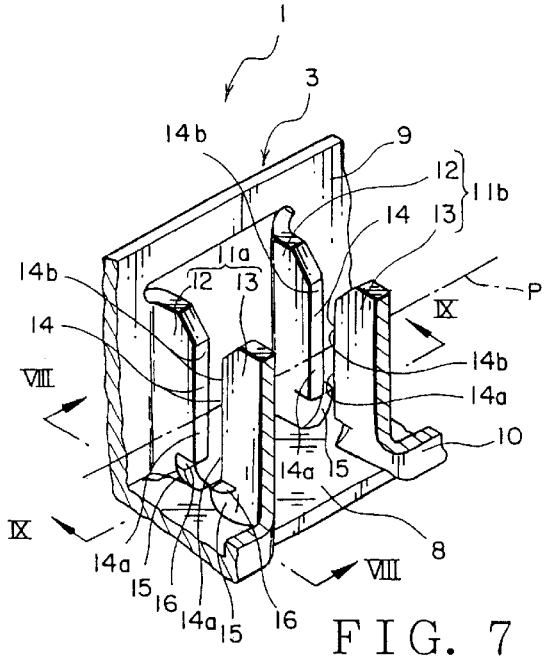
FIG. 7 is a perspective view illustrating a wire connection part of a pressure-welding terminal according to a second preferred embodiment of the present invention.
Figure 8:
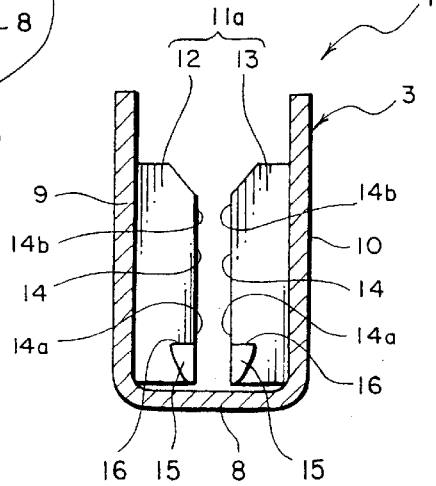
FIG. 8 is a cross sectional view taken along VIII—VIII line in FIG. 7.
Figure 9:
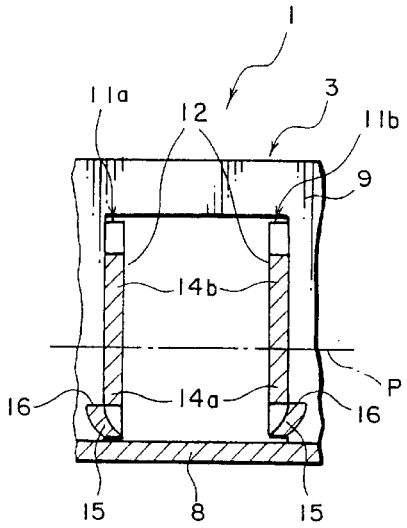
FIG. 9 is a cross sectional view taken along IX—IX line in FIG. 7.

In the second preferred embodiment, as shown in FIGS. 7–9, the projection 15 is formed in such a manner that the protrusion length of the projection 15 from the inner edge 14 of the blade 12, 13 gradually increases as the projection 15 leaves the bottom wall 8. The end surface 16 of the projection 15 situated far from the bottom wall 8 crosses the surface of the blade 12, 13. That is, there is formed a step at the far side of the projection 15 from the bottom wall 8 relatively to the blade 12, 13. The pressure-welding terminal 1 according to the second preferred embodiment is also produced by bending a metal plate 20 shown in FIG. 10 along alternate long and two short dashes lines R.

Figure 11A:
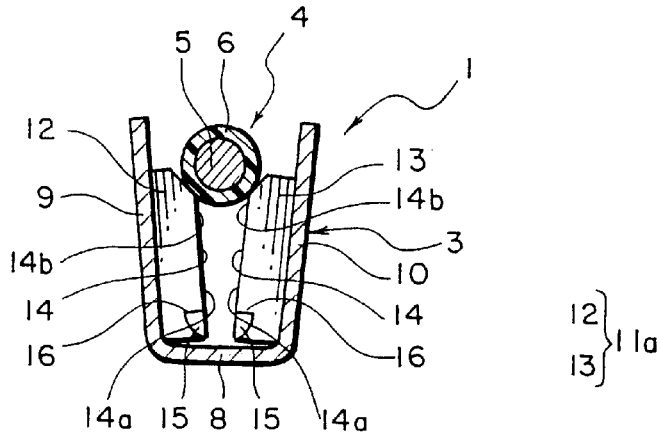
FIGS. 11A, 11B and 11C are a cross sectional view illustrating a process, in which a wire is press-fit into between pressure-welding blades of the wire connection part shown in FIG. 7.

The wire 4 is connected to the wire connecting part 3 of the pressure-welding terminal 1 of the second preferred embodiment as follows. When the wire 4 is press-fit in the direction of approaching the bottom wall 8, as shown in FIG. 11A, the end 14*b* of the inner edge 14 of the blade 12, 13 comes in contact with the wire 4 and the distance between both ends 14*b* increases. Then, the inner edge 14 cuts the coating 6, thereby the inner edge 14 comes in contact with the core wire 5.

Figure 11B:
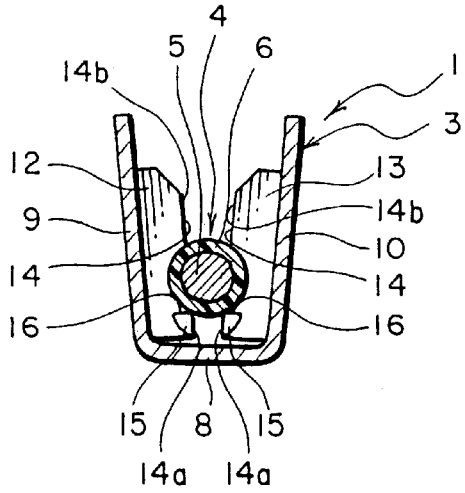
Figure 11C:
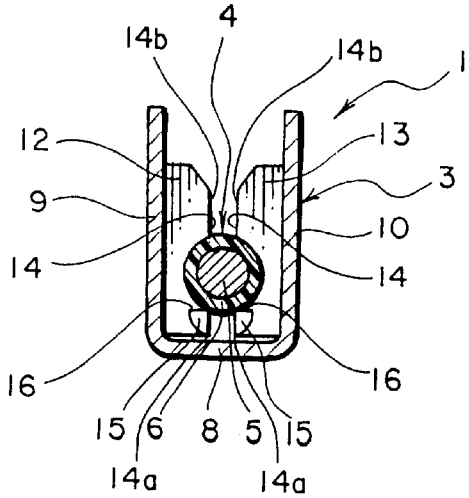
Figure 14:
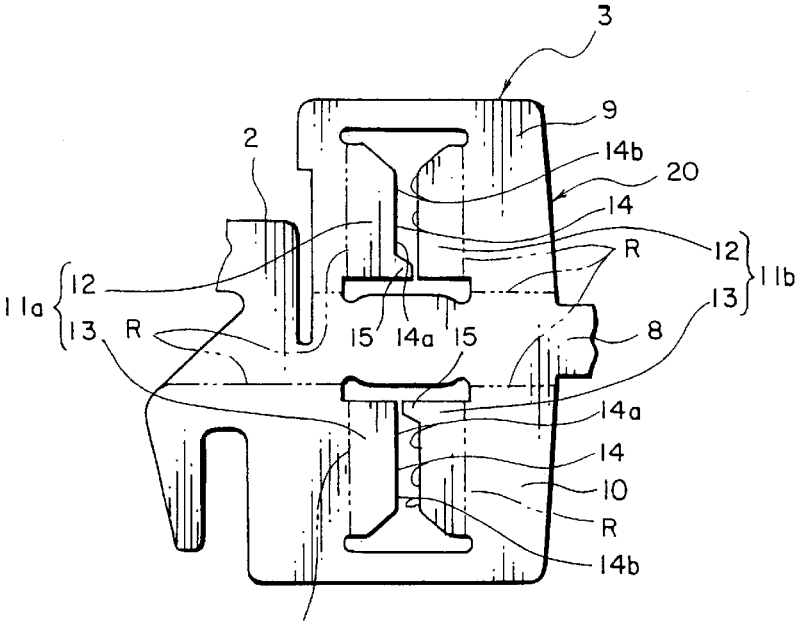
FIG. 14 is a plan view illustrating a part of a metal plate, which forms the pressure-welding terminal shown in FIG. 12.

Then, as shown in FIG. 11B, the wire 4 comes in contact with the projection 15. When the wire 4 further approaches the bottom wall 8, the wire 4 pushes the projection 15 toward the bottom wall 8, since the projection 15 is formed on the end 14*a* and protrudes from the end 14*a*. Then, as shown in FIG. 11C, the blades 12 and 13 are displaced in the direction, in which the distance between both ends 14*b* decreases. Thus, the blades 12 and 13 are displaced in the direction, in which the distance between the blades 12 and 13 decreases.

Thus, when the wire 4 is press-fit into between the blades 12 and 13, the edges 14 of the blades 12 and 13 cut the coating 6 of the wire 4 so as to come in contact with the core wire 5, thereby the blades 12 and 13 are electrically connected to the core wire 5. Thus, the first and second pressure-welding members 11*a* and 11*b* are press-fit to the wire 4, that is, the pressure-welding terminal 1 is press-fit to the wire 4, thereby the pressure-welding terminal 1 is electrically connected to the wire 4.

With the construction according to the second preferred embodiment, when the wire 4 is press-fit into between the blades 12 and 13, the wire 4 comes in contact with the projection 15, since the projection 15 is formed on the end 14*a* near to the bottom wall 8. Then, the wire 4 pushes the projection 15 toward the bottom wall 8. Then, the blades 12 and 13 are displaced in the direction, in which both ends 14*b* situated far from the bottom wall 8 approach each other, since the projection 15 is formed at the end 14*a* of the blades 12, 13. Then, the distance between the blades 12 and 13 decreases.

Therefore, when the wire 4 is press-fit into between the blades 12 and 13, the distance between the blades 12 and 13 is prevented from increasing. Therefore, the blades 12, 13 securely come in contact with the core wire 5, thereby the pressure-welding terminal 1 is securely electrically connected to the wire 4.

The projection protrudes from the end 14*a* along the alternate long and short dash line P. Therefore, the projection 15 is prevented from coming in contact with the core wire 5 of the wire 4, thereby the core wire 5 is prevented from being damaged. That is, the pressure-welding terminal 1 can be securely electrically connected to the wire 4.

Each projection 15 protruding from the inner edge 14 of the blades 12, 13 of the first pressure-welding member 11*a* protrudes in the same direction from the corresponding end 14*a*. Each projection 15 protruding from the inner edge 14 of the blades 12, 13 of the second pressure-welding member 11*b* protrudes in the same direction from the corresponding end 14*a*. Therefore, when the wire 4 is press-fit into between the blades 12 and 13, the projection 15 securely comes in contact with the wire 4. Therefore, the blades 12 and 13 more securely comes in contact with the core wire 5, thereby the pressure-welding terminal 1 is more securely electrically connected to the wire 4.

The projection 15 protrudes from the inner edge 14 of the blades 12, 13 along the alternate long and short dash line P. The projection 15 can be formed by bending (or embossing) a material for the inner edge 14 of the blade 12, 13. Therefore, there is no need to enlarge the distance between the blades 12 and 13 in order to form the projection 15. Therefore, the pressure-welding terminal 1 can be prevented from having a large size and can be securely electrically connected to a relatively thin wire 4.

Moreover, the protrusion length of the projection 15 from the blade 12, 13 gradually increases as the projection 15 leaves the bottom wall 8. The end surface 16 of the projection 15 crosses the surface of the blade 12, 13. That is, there is formed a step at the far side of the projection 15 from the bottom wall 8 relatively to the blade 12, 13. Therefore, when the wire 4 is press-fit into between the blades 12 and 13 and the wire 4 comes in contact with the projection 15, the protrusion length of the projection 15 from the blade 12, 13 can be prevented from decreasing.

Therefore, the wire 4 can more securely push the projection 15 toward the bottom wall 8 and the distance between the blades 12 and 13 can securely be prevented from increasing when the wire 4 is press-fit into between the blades 12 and 13. Therefore, the blade 12, 13 can more securely come in contact with the core wire 5, thereby the pressure-welding terminal 1 can more securely be connected electrically to the wire 4.

Figure 12:
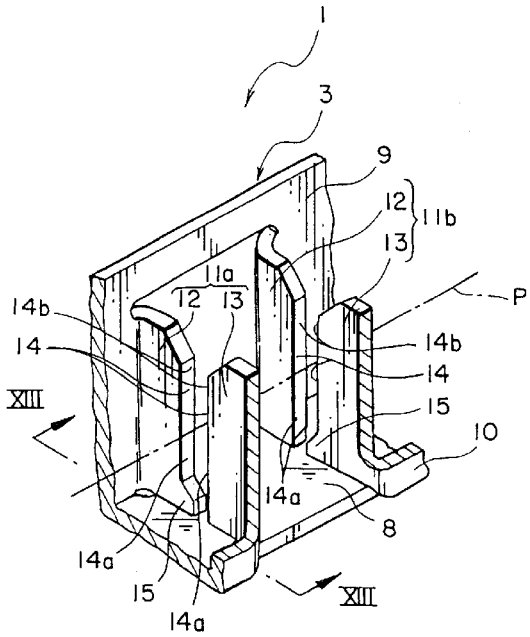
FIG. 12 is a perspective view illustrating a wire connection part of a pressure-welding terminal according to a third preferred embodiment of the present invention.
Figure 13:
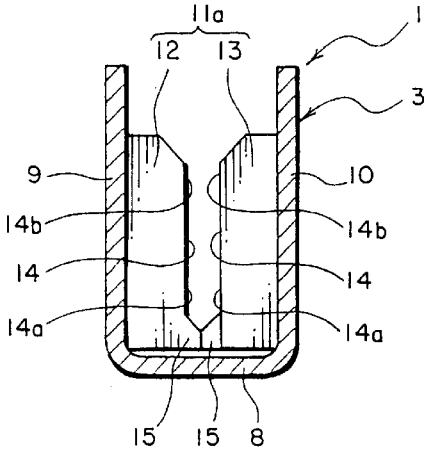
FIG. 13 is a cross sectional view taken along XIII—XIII line in FIG. 12.
Figure 10:
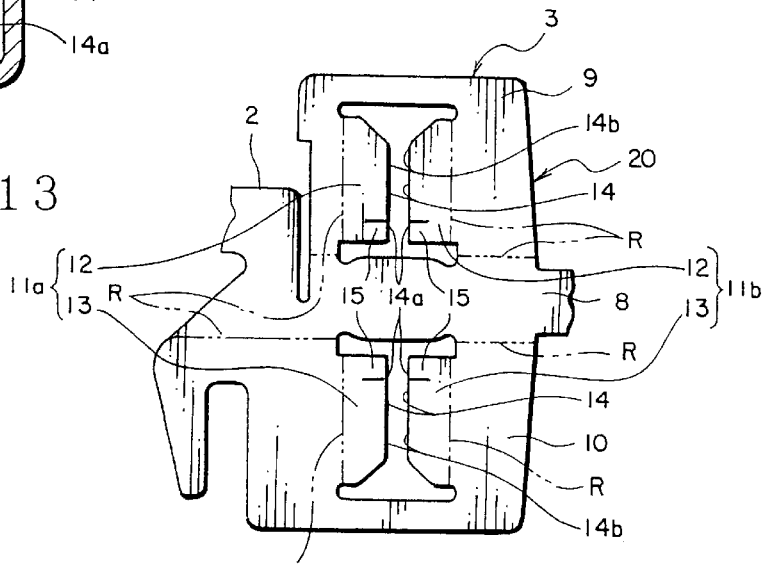
FIG. 10 is a plan view illustrating a part of a metal plate, which forms the pressure-welding terminal shown in FIG. 7.

In the following, a pressure-welding terminal 1 as a terminal fitting according to a third preferred embodiment of the present invention will be explained with reference to FIGS. 12–15. In the third preferred embodiment, as shown in FIGS. 12 and 13, each of the first and second pressure-welding members 11*a* and 11*b* includes only one projection 15.

As for the first pressure-welding member 11*a*, the projection 15 is formed on one pressure-welding blade 12 continuing to one side wall 9. As for the second pressure-welding member 11*b*, the projection 15 is formed on the other pressure-welding blade 13 continuing to the other side wall 10. The projection 15 protrudes from the inner edge 14 of the blade 12, 13 in the direction, in which the blades 12 and 13 approach each other. The pressure-welding terminal 1 of the third preferred embodiment is also produced by bending a metal plate 20 shown in FIG. 14 along alternate long and two short dashes lines R.

Figure 15A:
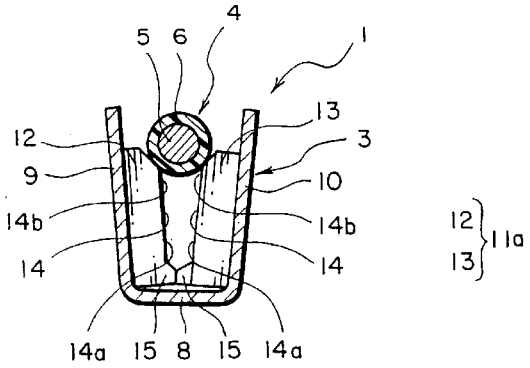
FIGS. 15A, 15B and 15C are a cross sectional view illustrating a process, in which a wire is press-fit into between pressure-welding blades of the wire connection part shown in FIG. 12.

The wire 4 is connected to the wire connecting part 3 of the pressure-welding terminal 1 of the third preferred embodiment as follows. When the wire 4 is press-fit in the direction of approaching the bottom wall 8, as shown in FIG. 15A, the end 14*b* of the inner edge 14 of the blade 12, 13 comes in contact with the wire 4 and the distance between both ends 14*b* increases. Then, the inner edge 14 cuts the coating 6, thereby the inner edge 14 comes in contact with the core wire 5.

Figure 15B:
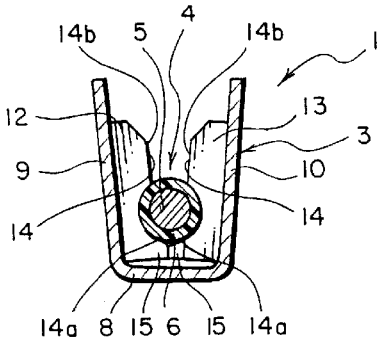
Figure 15C:
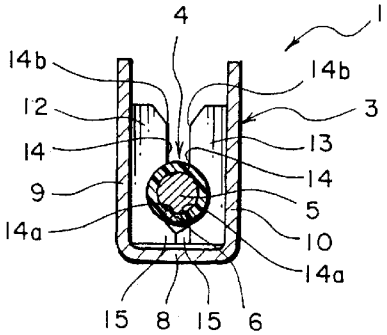
Figure 22A:
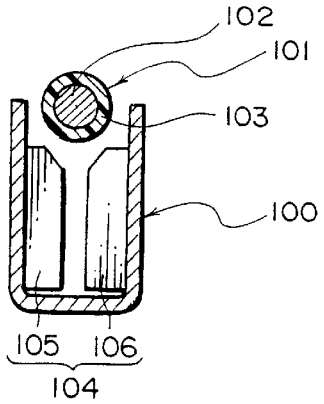
PRIOR ART FIG. 22A
FIGS. 22A, 22B and 22C are a cross sectional view illustrating a process, in which a wire is press-fit into between pressure-welding blades of the pressure-welding member shown in FIG. 20.
Figure 20:
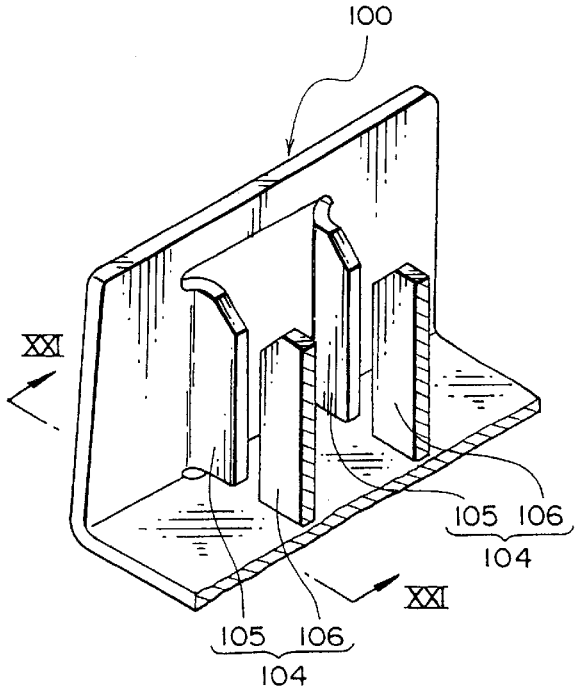
PRIOR ART FIG. 20
FIG. 20 is a perspective view illustrating a pressure-welding member of a conventional pressure-welding terminal.
Figure 22B:
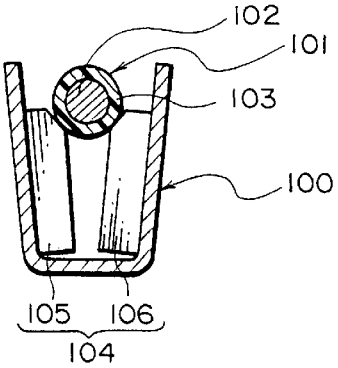
PRIOR ART FIG. 22B
Figure 21:
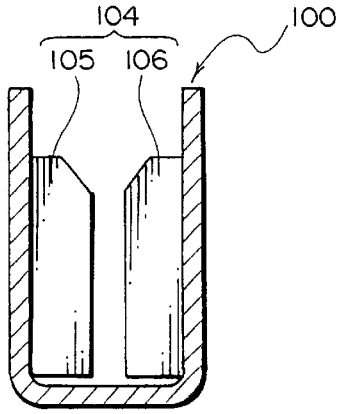
PRIOR ART FIG. 21
FIG. 21 is a cross sectional view taken along XXI—XXI line in FIG. 20.
Figure 22C:
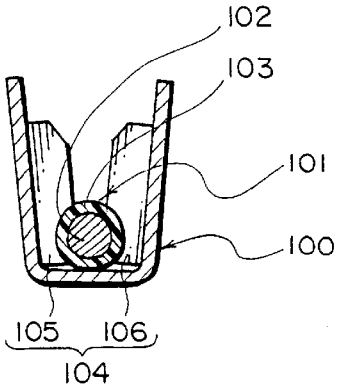
PRIOR ART FIG. 22C

Then, as shown in FIG. 15B, the wire 4 comes in contact with the projection 15. When the wire 4 further approaches the bottom wall 8, the wire 4 pushes the projection 15 toward the bottom wall 8, since the projection 15 is formed on the end 14*a* and protrudes from the end 14*a*. Then, since one projection 15 continues to one side wall 9 through one blade 12 while the other projection 15 continues to the other side wall 10 through the other blade 13, as shown in FIG. 15C, the blades 12 and 13 are displaced in the direction, in which the distance between both ends 14*b* decreases. Thus, the blades 12 and 13 are displaced in the direction, in which the distance between the blades 12 and 13 decreases.

Thus, when the wire 4 is press-fit into between the blades 12 and 13, the edges 14 of the blades 12 and 13 cut the coating 6 of the wire 4 so as to come in contact with the core wire 5, thereby the blades 12 and 13 are electrically connected to the core wire 5. Thus, the first and second pressure-welding members 11*a* and 11*b* are press-fit to the wire 4, that is, the pressure-welding terminal 1 is press-fit to the wire 4, thereby the pressure-welding terminal 1 is electrically connected to the wire 4.

In the third preferred embodiment, the one projection 15 protrudes from the end 14*a* near to the bottom 8 of the inner edge 14 of the one blade 12, which continues to the one side wall 9, while the other projection 15 protrudes from the end 14*a* near to the bottom 8 of the inner edge 14 of the other blade 13, which continues to the other side wall 10. Therefore, when the wire 4 is press-fit into between the blades 12 and 13, the wire 4 comes in contact with the projection 15 and pushes the projection 15 toward the bottom wall 8. Then, the blades 12 and 13 are displaced in the direction, in which both ends 14*b* of the blades 12, 13 situated far from the bottom wall 8 approach each other. Therefore, the distance between the pair of the side walls 9 and 10 is prevented from increasing and the distance between the blades 12 and 13 is prevented from increasing.

Therefore, when the wire 4 is press-fit into between the blades 12 and 13, the distance between the blades 12 and 13 is prevented from increasing. Therefore, the blades 12, 13 securely come in contact with the core wire 5, thereby the pressure-welding terminal 1 is securely electrically connected to the wire 4.

As for the first pressure-welding member 11*a*, the projection 15 is formed on the end 14*a* of one pressure-welding blade 12. As for the second pressure-welding member 11*b*, the projection 15 is formed on the end 14*a* of the other pressure-welding blade 13. Therefore, there is no need to enlarge the distance between the blades 12 and 13 in order to form the projection 15. Therefore, the pressure-welding terminal 1 can be prevented from having a large size and can be securely electrically connected to a relatively thin wire 4.

Figure 18:
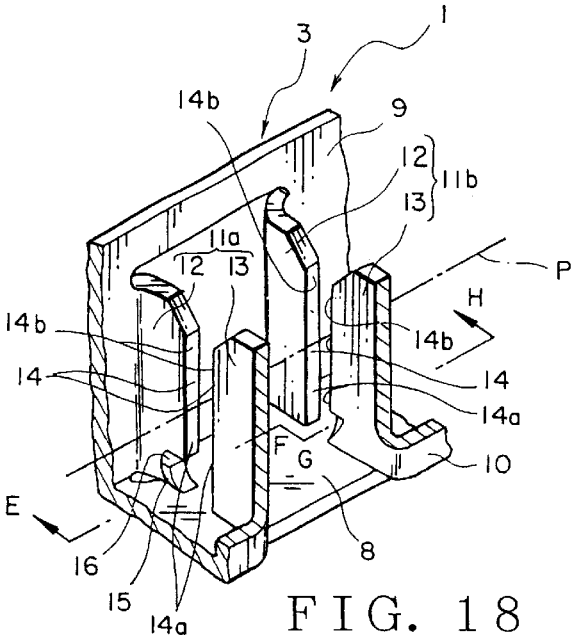
FIG. 18 is a perspective view illustrating another modified example of the wire connection part shown in FIG. 12.
Figure 16:
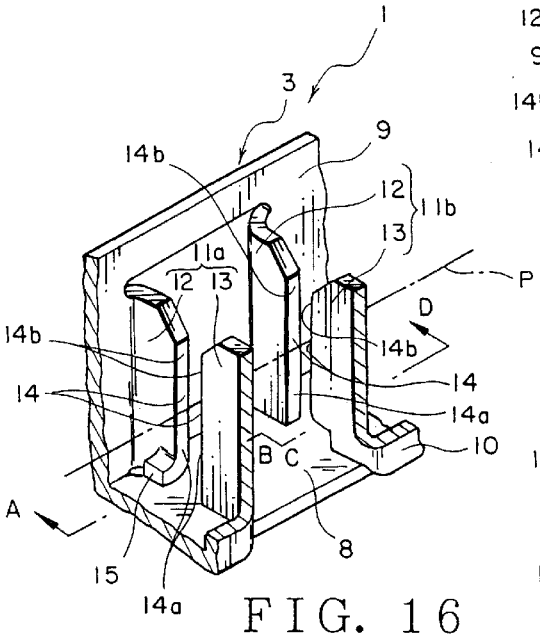
FIG. 16 is a perspective view illustrating a modified example of the wire connection part shown in FIG. 12.
Figure 17:
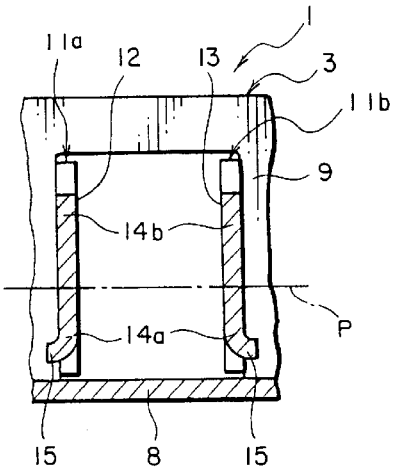
FIG. 17 is a cross sectional view taken along A–B–C–D line in FIG. 16.

Similarly to the first and second preferred embodiments, in the third preferred embodiment, as shown in FIGS. 16–18, the projection 15 may protrudes from the end 14*a* of the inner edge 14 of the blades 12, 13 along alternate long and two short dashes lines R. In an example shown in FIGS. 16 and 17, similarly to the first preferred embodiment, the protrusion length of the projection 15 from the end 14*a* gradually increases as the projection 15 approaches the bottom wall 8.

Figure 19:
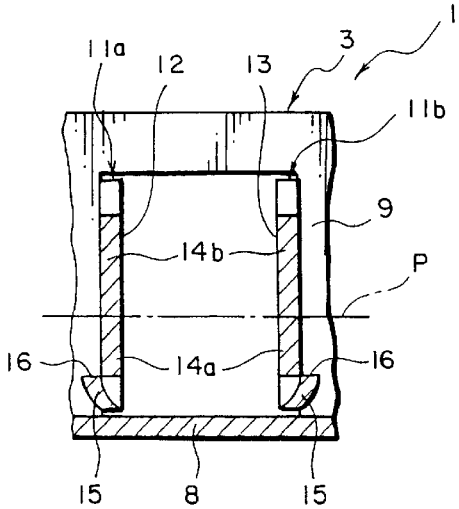
FIG. 19 is a cross sectional view taken along E–F–G–H line in FIG. 18.

In an example shown in FIGS. 18 and 19, similarly to the second preferred embodiment, the protrusion length of the projection 15 from the end 14*a* gradually increases as the projection 15 leaves the bottom wall 8. The end surface 16 crosses the surface of the blade 12, 13. There is formed a step at the far side of the projection 15 from the bottom wall 8 relatively to the blade 12, 13.

When the wire 4 is press-fit into between the blades 12 and 13, the wire 4 comes in contact with the projection 15 and pushes the projection 15 toward the bottom wall 8. Then, the blades 12 and 13 are displaced in the direction, in which both ends 14*b* of the blades 12 and 13 far from the bottom wall 8 approach each other. Therefore, the distance between the pair of the side walls 9 and 10 can be prevented from increasing and the distance between the blades 12 and 13 can be prevented from increasing.

Therefore, when the wire 4 is press-fit into between the blades 12 and 13, the distance between the blades 12 and 13 is prevented from increasing. Therefore, the blades 12, 13 securely come in contact with the core wire 5, thereby the pressure-welding terminal 1 is securely electrically connected to the wire 4. The distance between the blades 12 and 13 can more securely be prevented from increasing. The pressure-welding terminal 1 can be prevented from having a large size and can be securely electrically connected to a relatively thin wire 4.

The aforementioned preferred embodiments are described to aid in understanding the present invention and variations may be made by one skilled in the art without departing from the spirit and scope of the present invention.

What is claimed is:

1. A terminal fitting comprising:

a bottom wall, on a surface of which an electric wire consisting of a copper wire and a coating is placed;

a pair of pressure-welding blades arranged in parallel with each other arising from the bottom wall, each pressure-welding blade including an inner edge for cutting the coating of the electric wire; and a projection formed on an end of the inner edge of each pressure-welding blade near to the bottom wall but not coming in contact with and not extending from the bottom wall, protruding from the end toward length direction of the electric wire, wherein the electric wire is press-fit into between the pair of pressure-welding blades, which cuts the coating of the electric wire so as to come in contact with the core wire of the electric wire.

2. The terminal fitting according to claim 1, wherein each projection protrudes in the same direction from the corresponding end.

3. A terminal fitting comprising:

a bottom wall, on a surface of which an electric wire consisting of a core wire and a coating is placed;

a pair of sidewalls arising from both edges of the bottom wall; and first and second pressure-welding members to be pressure-welded to the electric wire, each of which has a pair of pressure-welding blades and a projection protruding from an end of an inner edge of each pressure-welding blade near to the bottom wall but not coming in contact with and not extending from the bottom wall, each pressure-welding blade including the inner edge for cutting the coating of the electric wire, and a projection being formed at the end of the inner edge of one pressure-welding blade of the first pressure-welding member near to the bottom wall but not coming in contact with and not extending from the bottom wall and formed at the end of the inner edge of the opposite pressure-welding blade of the second pressure-welding member near to the bottom wall but not coming in contact with and not extending from the bottom wall, wherein the one pressure-welding blade continues to one side wall while the opposite pressure-welding blade continues to the opposite side wall, and the electric wire is press-fit into between the pair of pressure-welding blades which cuts the coating of the electric wire so as to come in contact with the core wire of the electric wire.

4. The terminal fitting according to claim 3, wherein the projection protrudes from the end in the length direction of the electric wire.

5. The terminal fitting according to claim 1, 2 or 4, wherein protrusion length of the projection from the end gradually increases as the projection approaches the bottom wall.

6. The terminal fitting according to claim 1, 2 or 4, wherein protrusion length of the projection from the end gradually increases as the projection leaves the bottom wall.

* * * * *